US009506458B2

(12) United States Patent
Yajima

(10) Patent No.: US 9,506,458 B2
(45) Date of Patent: Nov. 29, 2016

(54) LIQUID SUPPLY APPARATUS

(71) Applicant: Koganei Corporation, Tokyo (JP)

(72) Inventor: Takeo Yajima, Tokyo (JP)

(73) Assignee: KOGANEI CORPORATION, Tokyo (JP)

( * ) Notice: Subject to any disclaimer, the term of this patent is extended or adjusted under 35 U.S.C. 154(b) by 309 days.

(21) Appl. No.: 14/104,244

(22) Filed: Dec. 12, 2013

(65) Prior Publication Data

US 2014/0170005 A1 Jun. 19, 2014

(30) Foreign Application Priority Data

Dec. 14, 2012 (JP) ..... 2012-273045

(51) Int. Cl.

| | |
|---|---|
| ***F04B 11/00*** | (2006.01) |
| ***F04B 1/16*** | (2006.01) |
| ***F04B 1/14*** | (2006.01) |
| ***F04B 53/22*** | (2006.01) |

(52) U.S. Cl.

CPC ..... *F04B 11/005* (2013.01); *F04B 1/14* (2013.01); *F04B 1/148* (2013.01); *F04B 1/16* (2013.01); *F04B 53/22* (2013.01)

(58) Field of Classification Search

CPC ..... F04B 1/14; F04B 1/148; F04B 1/16; F04B 1/124; F04B 1/128; F04B 1/146; F04B 1/0417; F04B 27/08; F04B 27/10; F04B 9/111; F04B 43/107; F04B 11/005

USPC ..... 417/269, 271, 539, 222.1, 419; 91/504, 91/12.2; 74/53, 54, 55, 56, 60, 567, 569

See application file for complete search history.

(56) References Cited

U.S. PATENT DOCUMENTS

| | | | | | |
|---|---|---|---|---|---|
| 1,676,114 | A | * | 7/1928 | Rusdell | F04B 1/02 417/262 |
| 1,802,330 | A | * | 4/1931 | Boland | F01L 1/14 123/90.5 |
| 2,439,879 | A | * | 4/1948 | Allen | F02M 41/08 417/269 |
| 2,669,185 | A | * | 2/1954 | Tallis | F04B 1/146 417/269 |
| 3,058,369 | A | * | 10/1962 | Vogel | F02M 41/121 74/55 |
| 3,099,260 | A | * | 7/1963 | Birtwell | A61M 1/1086 128/DIG. 3 |
| 3,101,077 | A | * | 8/1963 | Engle | F01L 1/14 123/90.5 |

(Continued)

FOREIGN PATENT DOCUMENTS

| | | | | | |
|---|---|---|---|---|---|
| GB | 837087 | A | * | 6/1960 | F02M 59/00 |
| GB | 1037622 | A | * | 7/1966 | F03C 1/0409 |

(Continued)

OTHER PUBLICATIONS

Japanese Office Action corresponding to JP 2012-273045 dated Oct. 6, 2015 (See English translation attached).

*Primary Examiner* — Alexander Comley
(74) *Attorney, Agent, or Firm* — McCormick, Paulding & Huber LLP

(57) ABSTRACT

In a liquid supply apparatus, plungers which respectively expand and contract pump chambers are reciprocated linearly in an axial direction with their phases shifted to each other, thereby continuously discharging liquid. In a pump block, drive rods are mounted so as to be reciprocatable in an axial direction. At a center in an axial direction of shafts attached to the drive rods, drive rollers are mounted, and rollers are mounted at both ends of the shafts. Guide grooves which support the guide rollers are formed in guide blocks.

9 Claims, 10 Drawing Sheets

(56) References Cited

U.S. PATENT DOCUMENTS 3,116,698 A * 1/1964 Kramer ..... F01B 3/0032 74/22 R
3,139,076 A * 6/1964 Flaherty ..... F01L 1/14 123/90.5
3,374,685 A * 3/1968 Eheim ..... F16H 25/125 74/56
3,406,633 A * 10/1968 Schomburg ..... F04B 43/0072 417/394
3,523,459 A * 8/1970 Mowbray ..... F16H 25/14 123/90.48
3,610,057 A * 10/1971 Repen ..... F01L 1/047 123/90.49
3,668,945 A * 6/1972 Hofmann ..... F02M 59/102 123/90.5
3,816,029 A * 6/1974 Bowen ..... F03C 1/08 417/223
3,976,400 A * 8/1976 Major ..... B01F 15/0454 417/248
3,998,190 A * 12/1976 Keske ..... F01L 1/14 123/90.5
4,089,234 A * 5/1978 Henson ..... F01L 1/14 123/90.5
4,152,953 A * 5/1979 Headley ..... F01L 1/14 123/90.48
4,155,683 A * 5/1979 Mochizuki ..... B01D 15/166 222/135
4,231,267 A * 11/1980 Van Slooten ..... F01L 1/245 123/90.48
4,335,685 A * 6/1982 Clouse ..... F01L 1/14 123/90.48
4,365,940 A * 12/1982 Hosokawa ..... F04B 1/14 417/269
4,566,858 A * 1/1986 Akiba ..... F04B 11/0058 417/22
4,734,187 A * 3/1988 Visentin ..... G01N 30/34 210/101
4,753,581 A * 6/1988 Hiscock ..... F04B 11/0066 417/269
5,022,356 A * 6/1991 Morel, Jr. ..... F01L 1/14 123/90.35
5,307,769 A * 5/1994 Meagher ..... F01L 1/14 123/90.5
5,361,733 A * 11/1994 Spath ..... F01L 1/14 123/90.16
5,520,144 A * 5/1996 Philo ..... F01L 1/143 123/90.5
5,775,275 A * 7/1998 Philo ..... F01L 1/143 123/90.5
6,206,649 B1 * 3/2001 Yie ..... F04B 1/124 137/509
6,302,660 B1 * 10/2001 Kurita ..... F04B 43/0072 417/383
6,893,228 B2 * 5/2005 Nelson ..... F04B 1/2014 417/270
7,311,087 B2 * 12/2007 Shaull ..... F02M 59/102 123/495
7,556,481 B2 * 7/2009 Moubayed ..... F04B 43/1253 417/477.1
2004/0009081 A1 * 1/2004 Grapes ..... F04B 43/107 417/478
2004/0011193 A1 * 1/2004 Moe ..... F04B 1/146 91/491
2012/0294741 A1 * 11/2012 Nishimura ..... F02M 59/102 417/437

FOREIGN PATENT DOCUMENTS

JP S43-28646 12/1943
JP S55-85582 6/1980
JP S57-70967 5/1981
JP 2006266250 A 10/2006

* cited by examiner

LIQUID SUPPLY APPARATUS

CROSS-REFERENCE TO RELATED APPLICATION

The present application claims priority from Japanese Patent Application No. 2012-273045 filed on Dec. 14, 2012, the content of which is hereby incorporated by reference into this application.

TECHNICAL FIELD OF THE INVENTION

The present invention relates to a liquid supply apparatus in which a plurality of plungers which reciprocate in an axial direction are driven in synchronization with each other to continuously discharge liquid.

BACKGROUND OF THE INVENTION

A liquid supply apparatus is used for coating a surface of a semiconductor wafer, a glass substrate for liquid crystal or the like with a chemical solution such as a photoresist solution. In one type of the liquid supply apparatus like this, as described in Japanese Patent Application Laid-Open Publication No. 2006-266250 (Patent Document 1), a bellows for expanding and contracting a pump chamber is provided. For the expansion and contraction of the bellows, the apparatus has a syringe body in which a piston rod, that is, a plunger is inserted so as to be reciprocatable in an axial direction, and the bellows is driven by expanding and contracting a syringe chamber filled with indirect liquid by the piston rod.

A liquid supply apparatus of a type which performs a pumping operation by reciprocating the piston rod is called a piston type or a syringe type. A chemical solution such as a photoresist solution is suctioned into the syringe chamber by expanding the syringe chamber and discharged by contracting the syringe chamber, thereby coating a coating target with the liquid discharged from the syringe chamber.

SUMMARY OF THE INVENTION

In the liquid supply apparatus in which the piston rod is reciprocated in an axial direction to perform the pumping operation, the liquid cannot be supplied to the coating target when the piston rod is expanding the syringe chamber. Therefore, if it is desired to continuously supply the liquid to the coating target, a plurality of piston rods are required to be mounted in the liquid supply apparatus.

However, when a plurality of pumps each having a piston rod are arranged in parallel with each other, the size of the liquid supply apparatus is increased, and therefore an increase in size of the entire apparatus is unavoidable. Moreover, when continuously coating a coating target with liquid such as a chemical solution, activation timings of the plurality of pumps are required to be set with high accuracy so that the amount of coating per unit time is not varied from the start to the end of coating.

An object of the present invention is to provide a liquid supply apparatus having a plurality of pumps and capable of continuously supplying liquid to a coating target.

The liquid supply apparatus of the present invention is a liquid supply apparatus having a plurality of pump chambers and continuously discharging liquid by expanding and contracting the pump chambers at different timings, and the apparatus includes: a pump block in which a plurality of drive rods which expand and contract the pump chambers are mounted so as to be reciprocatable in an axial direction; a shaft in which a drive roller is attached to a center part in an axial direction thereof and guide rollers are attached to both ends thereof, the shaft being mounted at a base end of each of the drive rods so as to be orthogonal to the drive rod; a plurality of guide blocks mounted in the pump block and each provided with a guide groove for guiding a movement of the guide roller in the axial direction; and an interlocking member provided in a rotation shaft rotatably mounted in the pump block, the interlocking member driving each of the drive rollers in the axial direction with their phases shifted to each other.

In this liquid supply apparatus, since a plurality of drive rods are driven in an axial direction and drive timings in the axial direction are shifted from each other, the liquid can be continuously supplied. Since the drive roller in contact with a cam face is provided at the center of the shaft provided on each drive rod and the guide rollers provided at both ends of the shaft are guided by guide grooves provided in the guide block, when the drive rods are reciprocated in the axial direction by an interlocking member, the drive rods are not tilted and the pumping operation can be smoothly performed. Thus, it is possible to supply the liquid at a constant flow rate from the start to the end of coating.

BRIEF DESCRIPTIONS OF THE DRAWINGS

DESCRIPTIONS OF THE PREFERRED EMBODIMENTS

Figure 1:
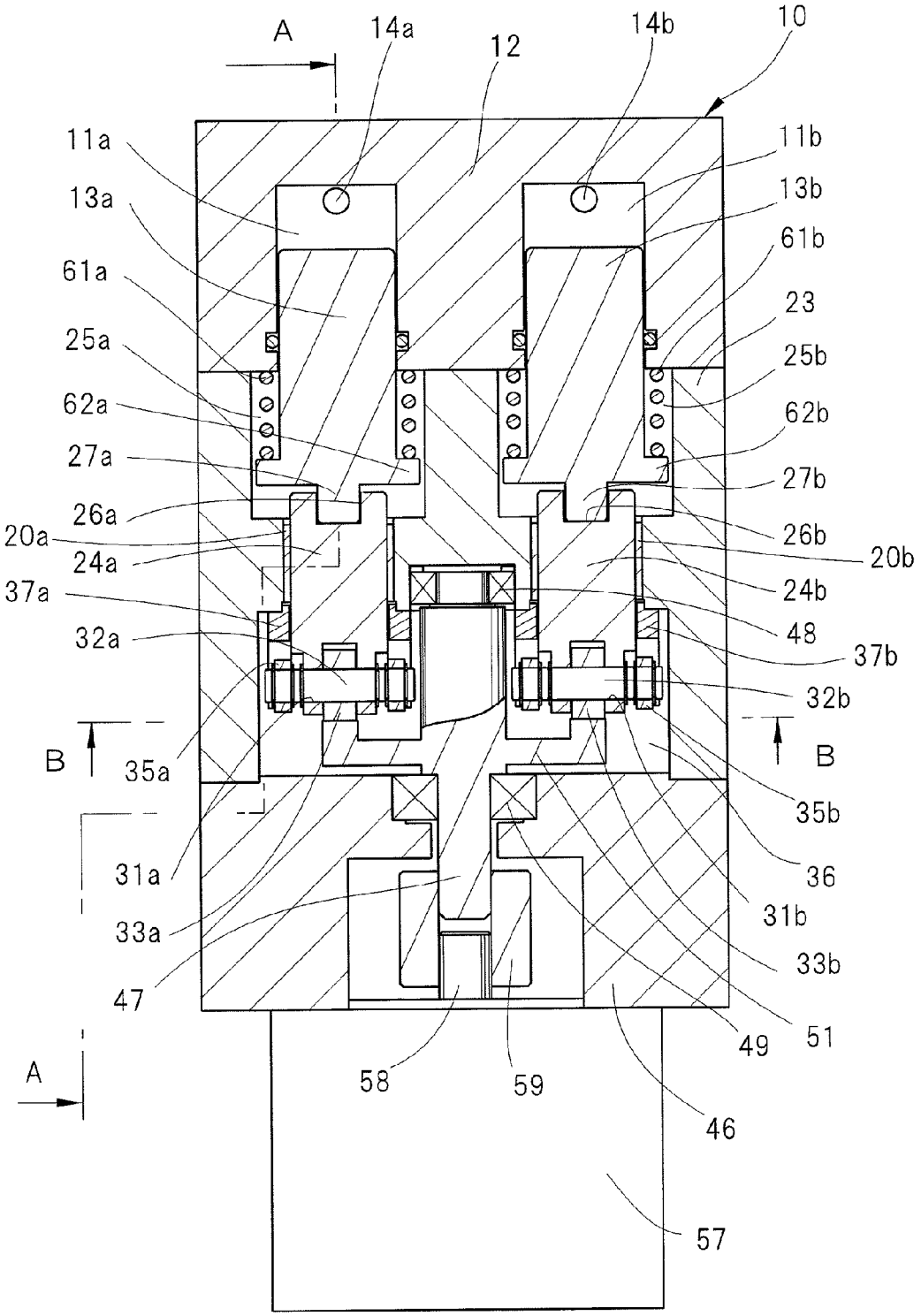
FIG. 1 is a longitudinal cross-sectional view of a liquid supply apparatus.
Figure 2:
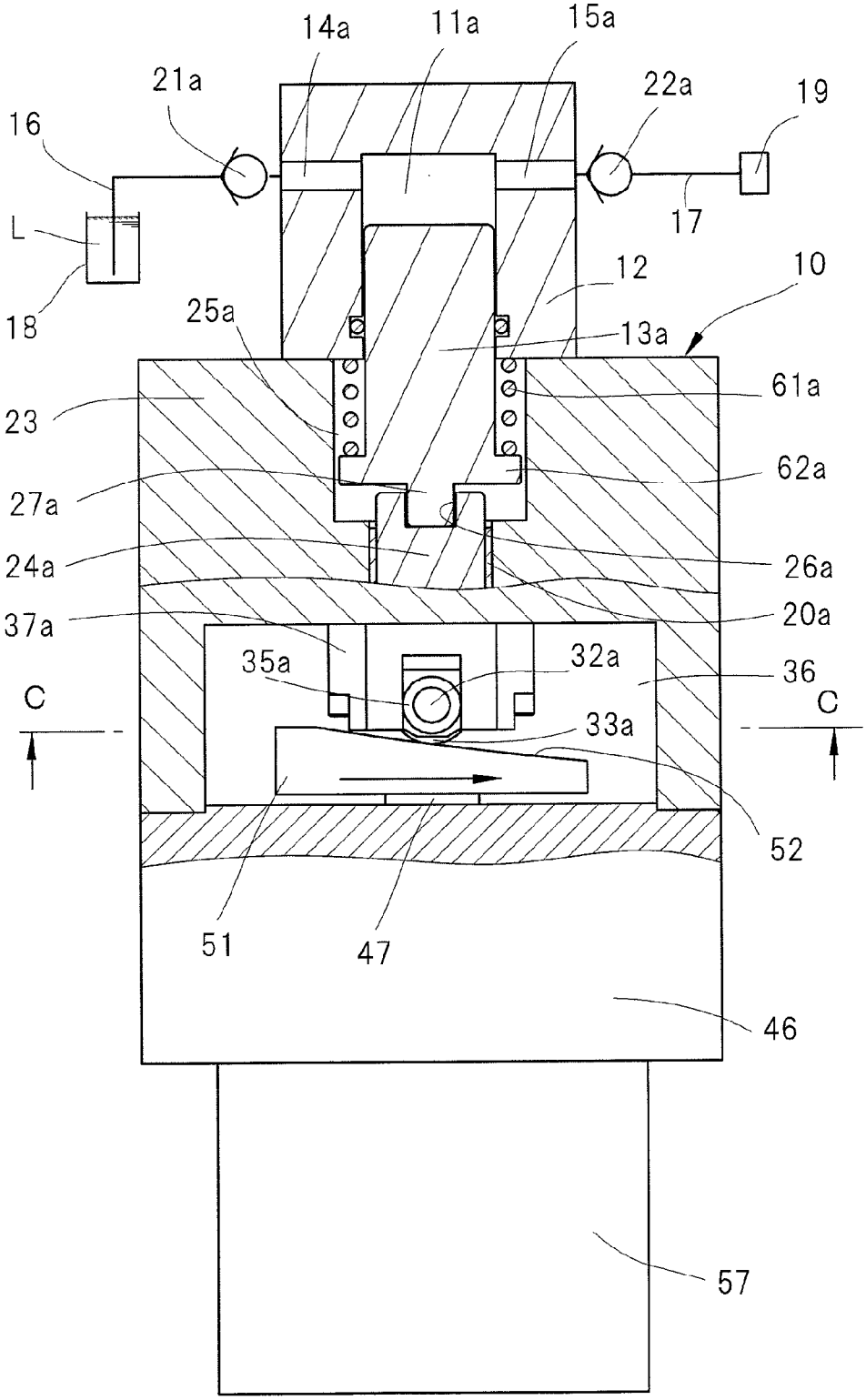
FIG. 2 is a cross-sectional view taken along the line A-A in FIG. 1.
Figure 3:
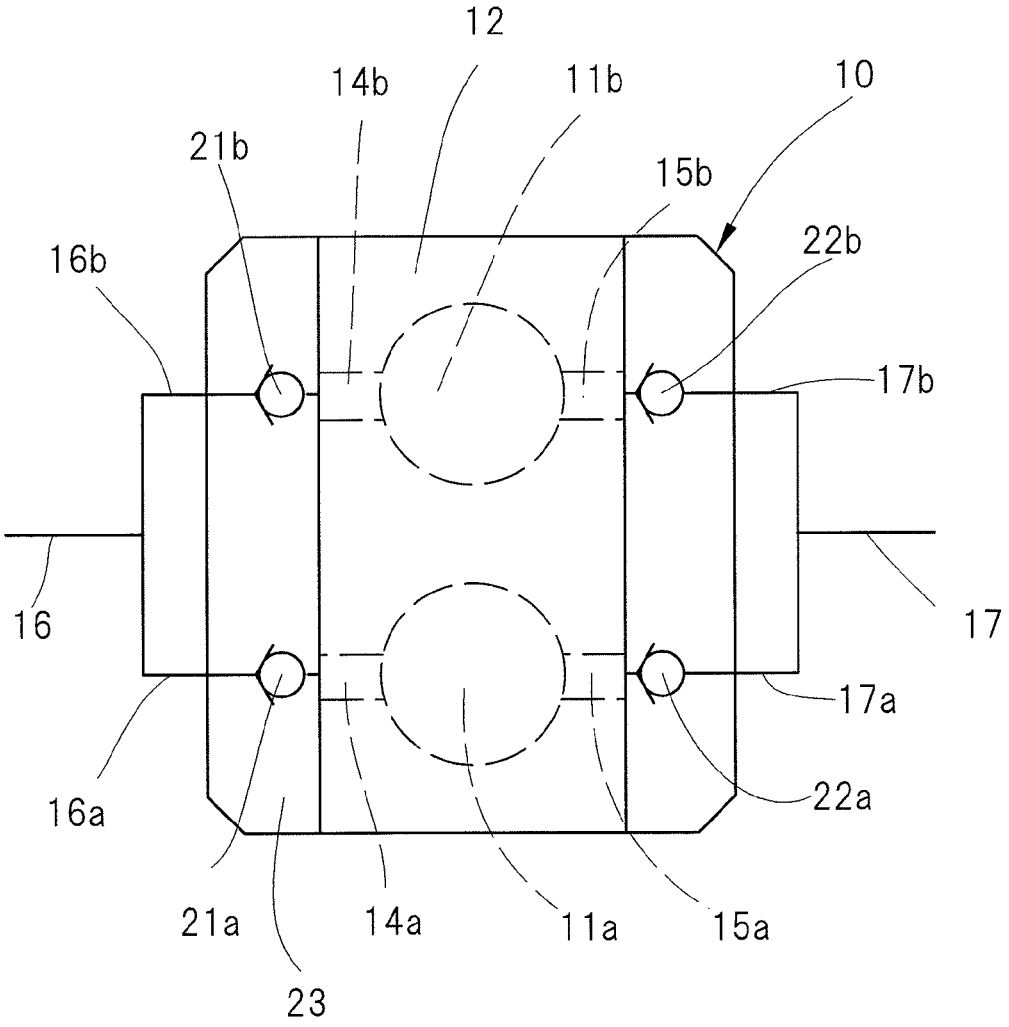
FIG. 3 is a plan view of FIG. 2.

Hereinafter, embodiments of the present invention will be described in detail with reference to the drawings. As shown in FIG. 1 to FIG. 3, a liquid supply apparatus 10 has a syringe body, that is, a cylinder block 12 having a plurality of bottomed pump chambers 11*a* and 11*b* formed therein. In the cylinder block 12, pistons, that is, plungers 13*a* and 13*b* are mounted in parallel with each other so as to be reciprocatable in an axial direction, and the pump chambers 11*a* and 11*b* are partitioned by the plungers 13*a* and 13*b*, respectively. As shown in FIG. 3, the cylinder block 12 is provided with suction ports 14*a* and 14*b* and discharge ports 15*a* and 15*b* so as to communicate with the pump chambers 11*a* and 11*b*, respectively. To the respective suction ports 14*a* and 14*b*, branching parts 16*a* and 16*b* of a suction-side pipe 16 are connected, and to the respective discharge ports 15*a* and 15*b*, branching parts 17*a* and 17*b* of a discharge-side pipe 17 are connected.

As shown in FIG. 2, the suction-side pipe 16 is connected to a liquid tank 18 containing liquid L such as a chemical solution, and the discharge-side pipe 17 is connected to a coating nozzle 19 for discharging the liquid L. When the plungers 13*a* and 13*b* move backward in a direction away from the bottom surfaces of the pump chambers 11*a* and 11*b*, the pump chambers 11*a* and 11*b* are expanded, and when the plungers 13*a* and 13*b* move forward in the opposite direction, the pump chambers 11*a* and 11*b* are contracted. The branching parts 16*a* and 16*b* of the suction-side pipe 16 are provided with check valves 21*a* and 21*b*, respectively. The check valves 21*a* and 21*b* guide the liquid in the liquid tank 18 to the pump chambers 11*a* and 11*b* when the pump chambers 11*a* and 11*b* are expanded, and inhibit backflow of the liquid from the inside of the pump chambers 11*a* and 11*b* toward the liquid tank 18 when the pump chambers 11*a* and 11*b* are contracted. The branching parts 17*a* and 17*b* of the discharge-side pipe 17 are provided with check valves 22*a* and 22*b*, respectively. The check valves 22*a* and 22*b* guide the liquid in the pump chambers 11*a* and 11*b* to the coating nozzle 19 when the pump chambers 11*a* and 11*b* are contracted, and inhibit backflow of the liquid from the coating nozzle 19 to the inside of the pump chambers 11*a* and 11*b* when the pump chambers 11*a* and 11*b* are expanded.

When one plunger 13*a* is moved forward and the other plunger 13*b* is moved backward at the same time, the liquid in the pump chamber 11*a* is discharged toward the coating nozzle 19, and at the same time, the liquid in the liquid tank 18 is suctioned into the pump chamber 11*b*. When the plunger 13*a* is driven to a forward movement limit position and the plunger 13*b* is driven to a backward movement limit position, and the plungers 13*a* and 13*b* are then moved in reverse in the axial direction, the liquid in the pump chamber 11*b* is discharged toward the coating nozzle 19, and the liquid is suctioned into the pump chamber 11*a*. In this manner, by causing the two plungers 13*a* and 13*b* to make linear reciprocating movements at different timings with their phases shifted to each other, the two pump chambers 11*a* and 11*b* are alternately expanded and contracted, and the liquid in the liquid tank 18 is continuously supplied toward the coating nozzle 19. In the liquid supply apparatus 10 shown in the drawings, two pump chambers 11*a* and 11*b* are provided in the cylinder block 12, and the two plungers 13*a* and 13*b* are provided in the cylinder block 12 so as to correspond to the pump chambers 11*a* and 11*b*. Alternatively, three or more pump chambers and also plungers may be provided in the cylinder block 12. Also in this case, by varying timings of movements of the respective plungers in the axial direction, the liquid can be continuously supplied from the coating nozzle 19 to a coating target.

A pump block 23 is mounted on the cylinder block 12, and the pump block 23 is attachable to and detachable from the cylinder block 12 with screw members (not shown). In the pump block 23, drive rods 24*a* and 24*b* are mounted coaxially with the plungers 13*a* and 13*b*, respectively, so as to be reciprocatable in the axial direction. In order to guide the movements of the drive rods 24*a* and 24*b* in the axial direction, bushes 20*a* and 20*b* are attached to the pump block 23. The drive rods 24*a* and 24*b* and the cylinder block 12 form pumps, and this liquid supply apparatus 10 has two pumps. Spring chambers 25*a* and 25*b*, to which base ends of the plungers 13*a* and 13*b* are inserted, are formed on a tip end side of the pump block 23, and tip ends of the drive rods 24*a* and 24*b* project into the spring chambers 25*a* and 25*b*, respectively. In recesses 26*a* and 26*b* formed at the tip ends of the drive rods 24*a* and 24*b*, small-diameter projections 27*a* and 27*b* provided at the base ends of the plungers 13*a* and 13*b* are inserted, respectively, and tip end faces of the small-diameter projections 27*a* and 27*b* abut on the bottom surfaces of the recesses 26*a* and 26*b*, respectively. As described above, the plungers 13*a* and 13*b* are attachably/detachably, that is, separably coupled to the drive rods 24*a* and 24*b*, and the cylinder block 12 is attachable to and detachable from the pump block 23. Since the plungers 13*a* and 13*b* are attachable to and detachable from the drive rods 24*a* and 24*b*, they are replaceable. Accordingly, when a sliding portion between the plungers 13*a* and 13*b* and the cylinder block 12 is worn out, at least either of the plungers 13*a* and 13*b* or the cylinder block 12 can be replaced.

Figure 6:
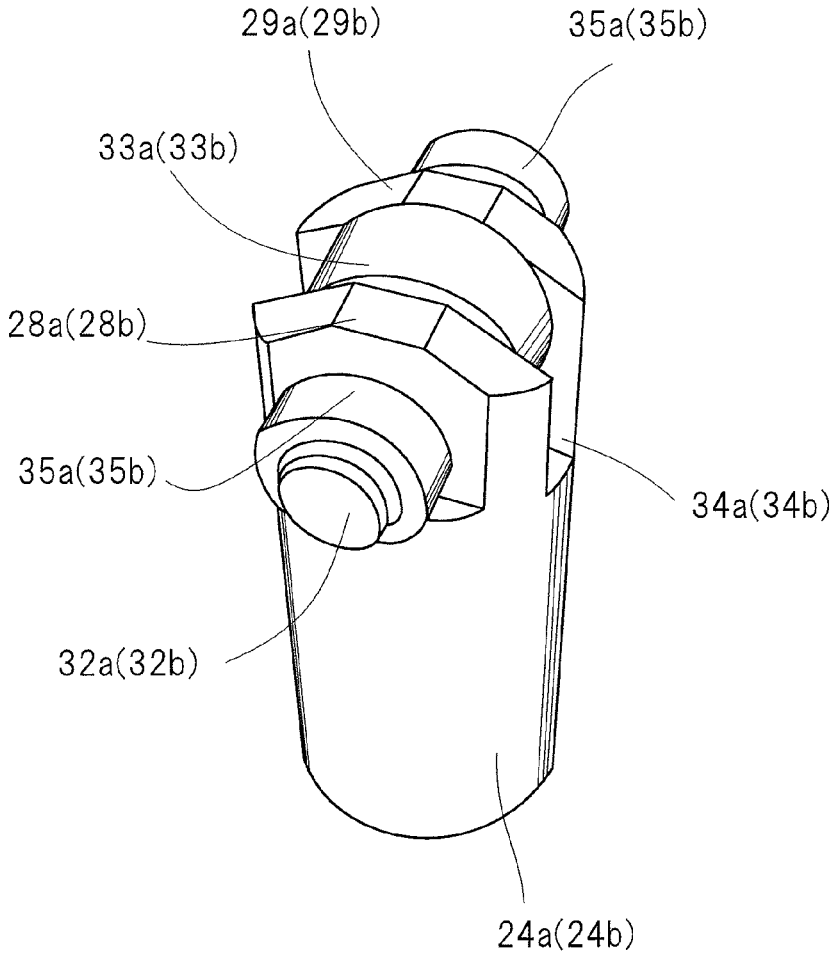
FIG. 6 is a perspective view showing one of two drive rods shown in FIG. 1.

FIG. 6 is a perspective view showing a base end side of one of the two drive rods 24*a* and 24*b*. At the base end of the drive rod 24*a*, a first projection 28*a* and a second projection 29*a* are provided. A first through hole 31*a* running in a radial direction of the drive rod 24*a* is provided through the both projections 28*a* and 29*a*, and a shaft 32*a* is inserted into the first through hole 31*a*. At the center of the shaft 32*a* in the axial direction, a drive roller 33*a* is rotatably mounted, and the drive roller 33*a* is disposed in an accommodation groove 34*a* formed between the two projections 28*a* and 29*a*. Guide rollers 35*a* are rotatably mounted at both ends of the shaft 32*a*, and the two guide rollers 35*a* protrude outward in the radial direction more than the outer circumferential surface of the drive rod 24*a*. An outer diameter of the drive rollers 33*a* and 33*b* is larger than that of the guide rollers 35*a* and 35*b*.

A base end of the other drive rod 24*b* also has the structure similar to that of the drive rod 24*a*, and a first projection 28*b* and a second projection 29*b* are provided. A first through hole 31*b* running in a radial direction of the drive rod 24*b* is provided through the both projections 28*b* and 29*b*, and a shaft 32*b* is inserted into the first through hole 31 b. At the center of the shaft 32*b* in the axial direction, a drive roller 33*b* is rotatably mounted, and the drive roller 33*b* is disposed in an accommodation groove 34*b* formed between the two projections 28*b* and 29*b*. Guide rollers 35*b* are rotatably mounted at both ends of the shaft 32*b*, and the two guide rollers 35*b* protrude outward in the radial direction more than the outer circumferential surface of the drive rod 24*b*. As shown in FIG. 1 and FIG. 6, the shafts 32*a* and 32*b* are mounted at the base ends of the drive rods 24*a* and 24*b* so as to be orthogonal to the axial directions of the drive rods 24*a* and 24*b*, respectively. As the drive rollers 33*a* and 33*b* and the guide rollers 35*a* and 35*b*, slide bearings or ball bearings are used.

As shown in FIG. 1, a cam accommodation chamber 36 is formed on the base end side of the pump block 23. Guide blocks 37*a* and 37*b* which guide the drive rods 24*a* and 24*b* in the axial direction via the guide rollers 35*a* and 35*b*, respectively, are disposed in the cam accommodation chamber 36, and the respective guide blocks 37*a* and 37*b* are attached to the pump block 23.

Figure 7:
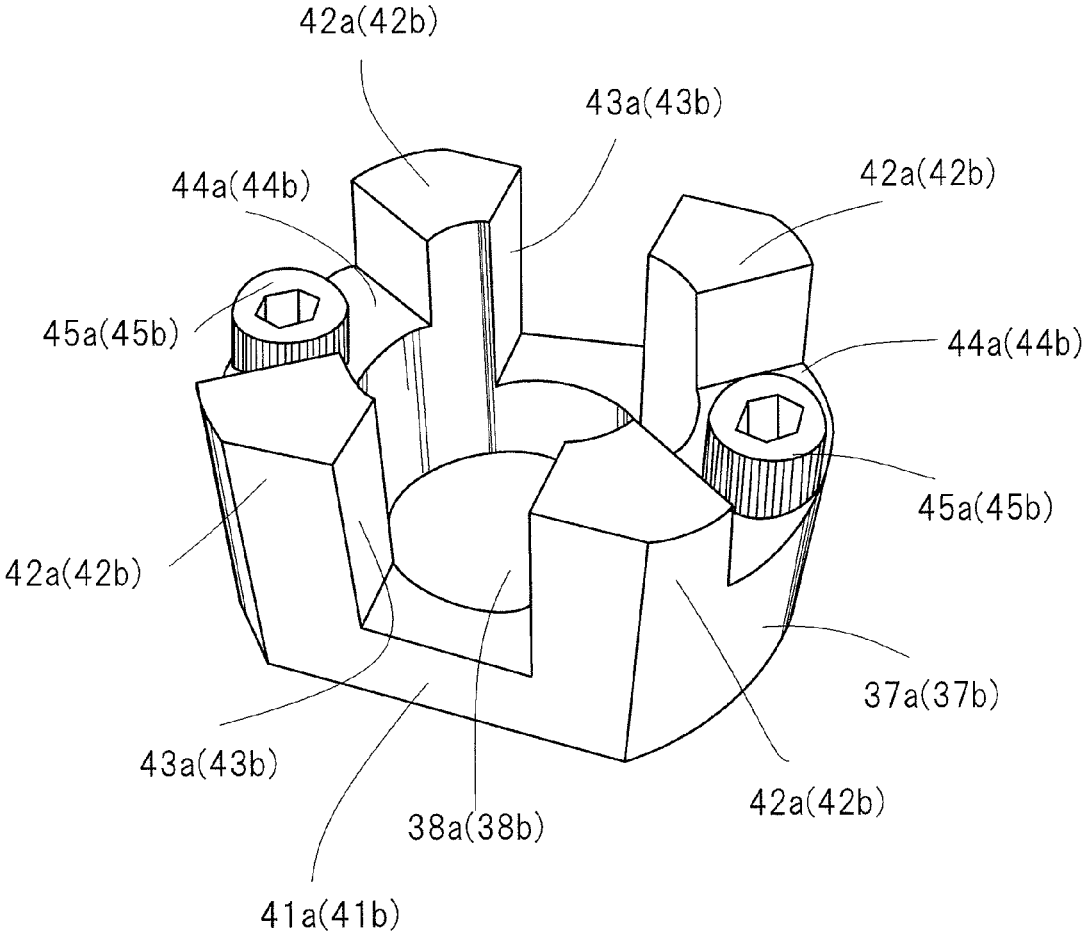
FIG. 7 is a perspective view showing one of two guide blocks shown in FIG. 1.

FIG. 7 is a perspective view showing a base end side of one of the two guide blocks 37*a* and 37*b*. As shown in FIG. 7, one guide block 37*a* has a base 41*a* provided with a second through hole 38*a* in which the drive rod 24*a* penetrates and four guide projections 42*a* projecting from the base 41*a* in the axial direction. Every two guide projections 42*a* form a pair, and two pairs are provided. The paired guide projections 42*a* are provided with a guide groove 43*a* for guiding the guide roller 35*a* provided on the shaft 32*a* in the axial direction. In notches 44*a* provided in the guide block 37*a* so as to be shifted in a circumferential direction with respect to the respective guide grooves 43*a*, screw members 45*a* are disposed, and the guide block 37*a* is fastened to the pump block 23 with the screw members 45*a*.

The other guide block 37*b* also has the structure similar to that of the guide block 37*a*. The guide block 37*b* has a base 41*b* provided with a second through hole 38*b* in which the drive rod 24*b* penetrates and four guide projections 42*b* projecting from the base 41*b* in the axial direction. The guide projections 42*b* are provided with a guide groove 43*b* for guiding the respective guide rollers 35*b* provided on the shaft 32*b* in the axial direction. In notches 44*b* provided in the guide block 37*b* so as to be shifted in a circumferential direction with respect to the respective guide grooves 43*b*, screw members 45*b* are disposed, and the guide block 37*b* is fastened to the pump block 23 with the screw members 45*b*.

Figure 8:
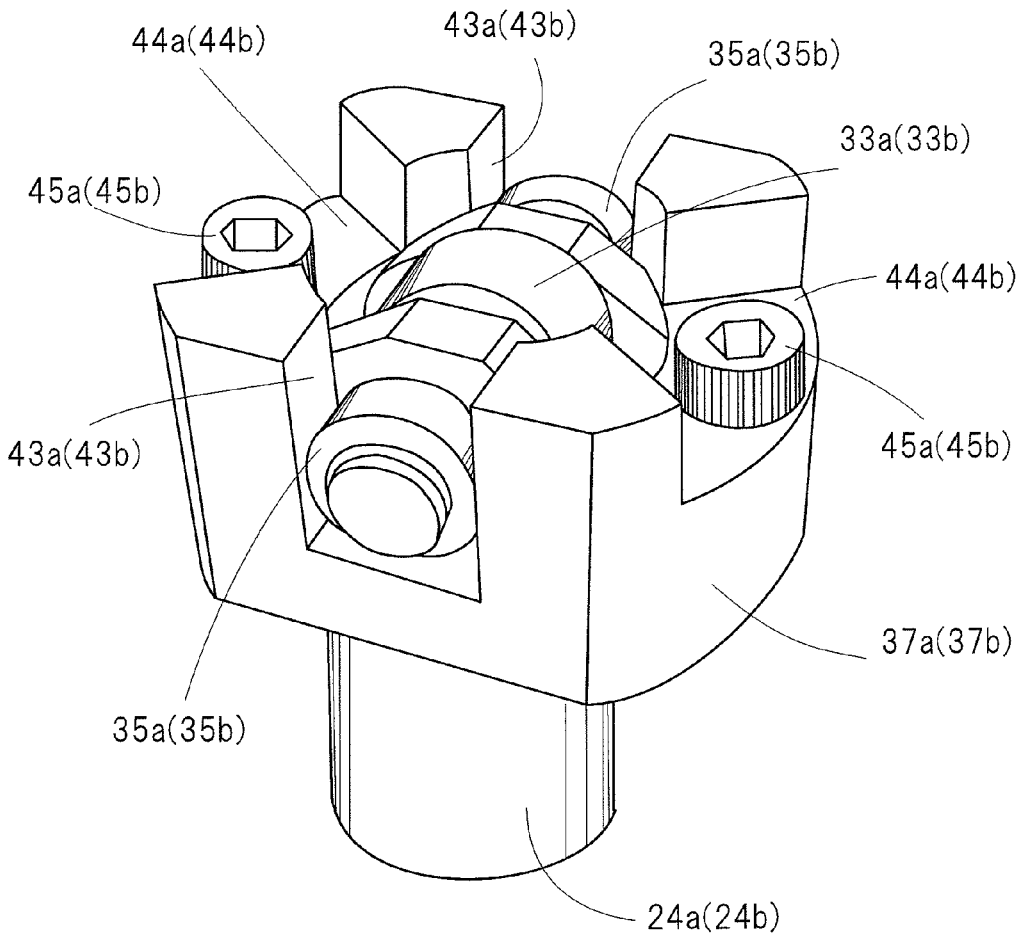
FIG. 8 is a perspective view showing a drive rod and a guide block in an assembled state.

FIG. 8 is a perspective view showing the state in which the drive rods 24*a* and 24*b* are assembled to the guide blocks 37*a* and 37*b*, respectively. The drive rollers 33*a* and 33*b* are disposed at positions on the center axes of the drive rods 24*a* and 24*b*, and the guide rollers 35*a* and 35*b* provided at both ends of the shafts 32*a* and 32*b* are accommodated in the guide grooves 43*a* and 43*b*, respectively. The guide rollers 35*a* and 35*b* can reciprocate in the guide grooves 43*a* and 43*b* in the axial direction, and the guide grooves 43*a* and 43*b* allow reciprocating movements of the drive rods 24*a* and 24*b*, but do not allow rotations of the drive rods 24*a* and 24*b*.

As shown in FIG. 1, a drive block 46 is attached to the pump block 23. A cam shaft 47 serving as a rotation shaft is rotatably provided in the drive block 46. The cam shaft 47 is provided in the drive block 46 between and in parallel with the two drive rods 24*a* and 24*b*. A tip end of the cam shaft 47 is supported by a bearing 48 provided in the pump block 23, and a base end of the cam shaft 47 is supported by a bearing 49 provided in the drive block 46. A cam member 51 with a disk-like shape is provided as an interlocking member in the cam shaft 47. Cam faces 52 with which the two drive rollers 33*a* and 33*b* are in contact are provided at end faces of the cam member 51, and the cam member 51 serves as an end cam. As shown in FIG. 1 and FIG. 2, the cam member 51 is integrated with the cam shaft 47. Alternatively, the cam member 51 and the cam shaft 47 may be provided as separate members, and the cam member 51 may be fixed to the cam shaft 47.

Figure 4:
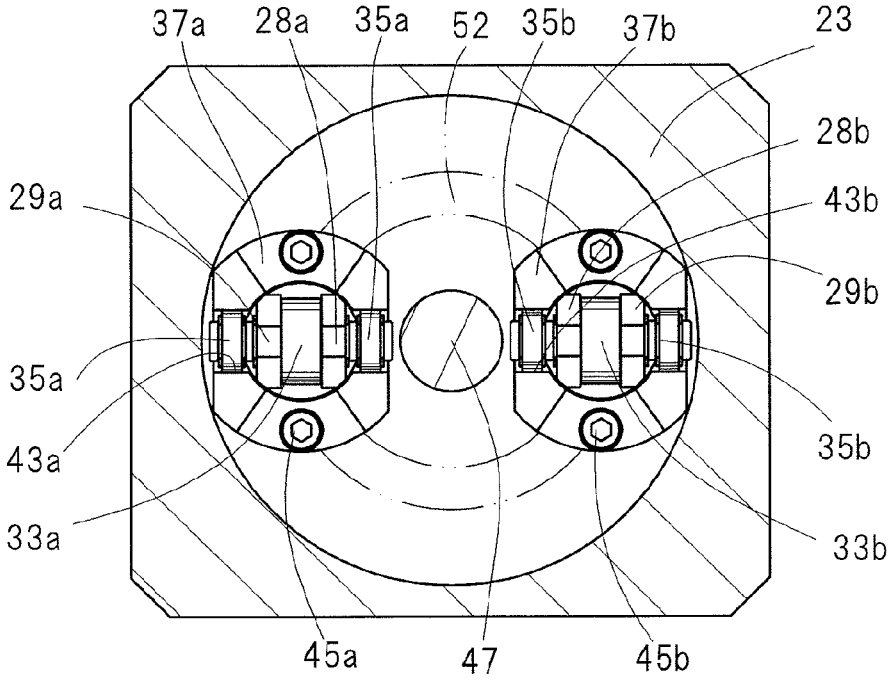
FIG. 4 is a cross-sectional view taken along the line B-B in FIG. 1.
Figure 5:
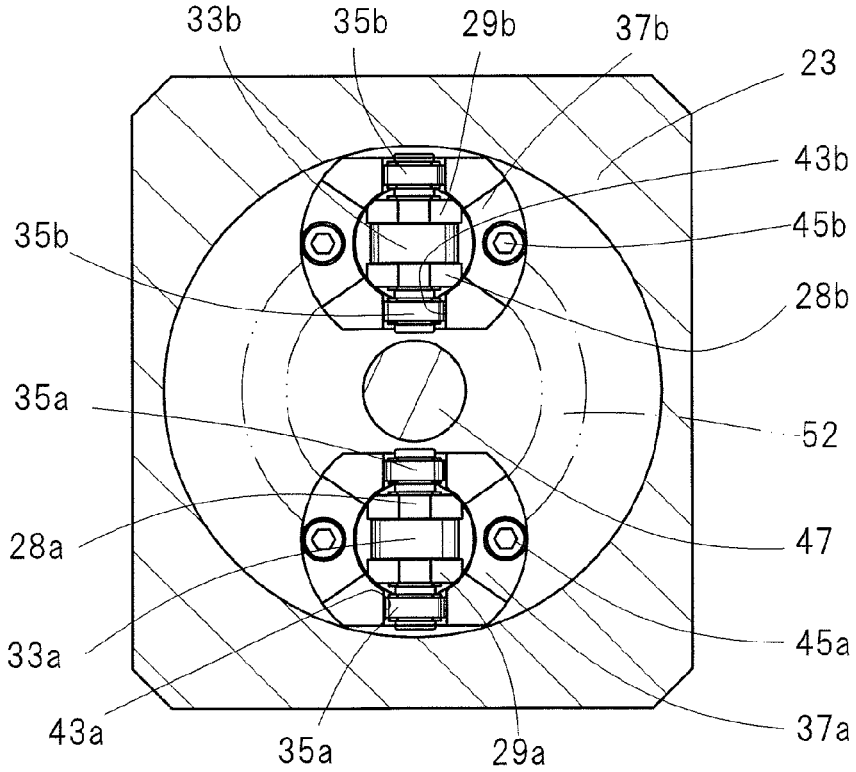
FIG. 5 is a cross-sectional view taken along the line C-C in FIG. 2.

As shown in FIG. 4 and FIG. 5, the two guide blocks 37*a* and 37*b* are attached to the pump block 23 at intervals of 180 degrees about the cam shaft 47 in the circumferential direction.

Figure 9:
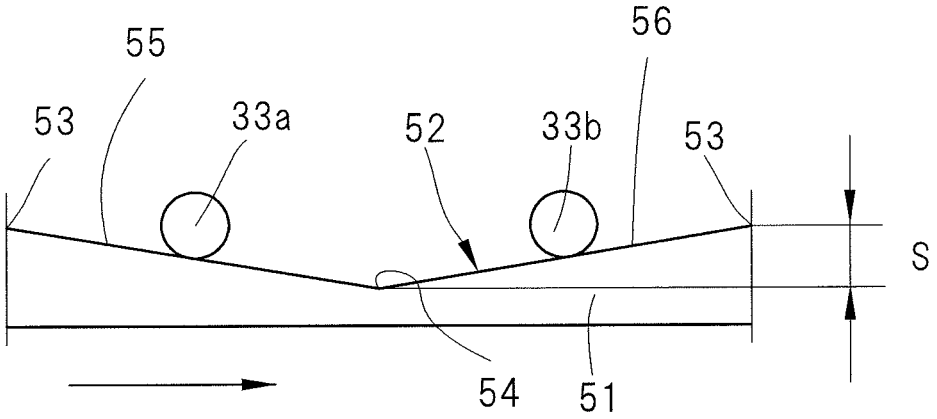
FIG. 9 is a development view showing a cam face of the cam member shown in FIG. 1.

FIG. 9 is a development view of the cam face 52 of the cam member 51. The cam face 52 has a boundary part 53 on a tip end side, a boundary part 54 on a rear end side, a first inclined surface 55 between the boundary part 53 and the boundary part 54, and a second inclined surface 56 inclined in a reverse direction with respect to the first inclined surface 55. In FIG. 9, a reference character S denotes a reciprocating movement stroke of both of the drive rollers 33*a* and 33*b* in the axial direction.

In this manner, when the drive rollers 33*a* and 33*b* are provided at the center of the shafts 32*a* and 32*b* and the guide rollers 35*a* and 35*b* provided at both ends of the shaft 32*a* and 32*b*, respectively, even if the drive rollers 33*a* and 33*b* in contact with the cam face 52 receive an external force in the circumferential direction in conjunction with the rotation of the cam shaft 47, the guide rollers 35*a* and 35*b* are guided by the guide groves 43*a* and 43*b*, and the drive rods 24*a* and 24*b* are moved only in the axial direction. Therefore, the drive rods 24*a* and 24*b* are smoothly reciprocated in the axial direction without being inclined. In this manner, the accuracy of the pumping operation is enhanced.

As shown in FIG. 1 and FIG. 2, for driving the cam shaft 47 to rotate, an electric motor 57 is mounted as driving means on the drive block 46, and a main shaft 58 of the electric motor 57 is coupled to the cam shaft 47 with a joint member 59. To apply a spring force in a backward direction to the plungers 13*a* and 13*b*, compression coil springs 61*a* and 61*b* are mounted as spring members on the plungers 13*a* and 13*b*. By the spring force of the compression coil springs 61*a* and 61*b*, a pressing force in a direction toward the cam face 52 is applied to the drive rollers 33*a* and 33*b*. One ends of the compression coil springs 61 a and 61 b abut on the flange portions 62*a* and 62*b* provided in the plungers 13*a* and 13*b*, and the other ends thereof abut on a rear end face of the cylinder block 12.

When the cam shaft 47 is driven to rotate by the electric motor 57, the respective drive rollers 33*a* and 33*b* roll along the cam face 52. In a former half cycle of rotation, one drive rod is driven to move forward against the pressing force by the coil spring, and the other drive rod is driven to move backward by the pressing force. In a latter half cycle, one drive rod is driven to move backward by the pressing force, and the other drive rod is driven to move forward against the pressing force of the coil spring. FIG. 2 and FIG. 9 each show the state in which the drive rollers 33*a* and 33*b* are in contact with the inclined surfaces 55 and 56 and the drive rods 24*a* and 24*b* are at the center of the reciprocating movement stroke in the axial direction. When the cam shaft 47 is driven to rotate in a direction indicated by an arrow in FIG. 2, the drive rod 24*a* is driven to move forward against the pressing force of the spring, and the drive rod 24*b* is driven to move backward by the spring force.

When the drive rod 24*a* is driven to move forward, the liquid in the pump chamber 11*a* is discharged via the check valve 22*a* to the discharge-side pipe 17, and the liquid is supplied to the coating nozzle 19. At this time, the drive rod 24*b* is driven to move backward, and the liquid L in the liquid tank 18 is suctioned into the pump chamber 11*b* via the check valve 21*b*. When the drive rollers 33*a* and 33*b* pass the boundary parts 53 and 54 in conjunction with the rotation of the cam shaft 47, the drive rod 24*a* is driven to move backward, and the drive rod 24*b* is driven to move forward. As a result, when the cam shaft 47 is continuously driven to rotate, the two drive rods 24*a* and 24*b* are continuously driven in mutually opposite directions, that is, with opposite phases, and the liquid in the liquid tank 18 is continuously supplied to the coating nozzle 19.

The cam member 51 is an end cam in which the cam face 52 is provided on an end face of a disk-like member. The pressing force toward the cam face 52 is applied to the drive rollers 33*a* and 33*b* by the compression coil springs 61*a* and 61 b serving as pressing means. Therefore, in the present invention, the size of the liquid supply apparatus 10 can be reduced, compared with the case in which a positive cam is adopted as the cam member 51 and a cam groove with which the drive rollers 33*a* and 33*b* are engaged is provided in the positive cam. However, a disk cam in which the cam face 52 is provided on an outer circumferential surface of the disk-like member may be used as a cam member. In the case of using the disk cam, two disk cams are disposed in the cam accommodation chamber 36 so as to correspond to both of the drive rollers 33*a* and 33*b*, and the rotation centers of the respective disk cams are perpendicular to the center axes of the drive rods 24*a* and 24*b*.

Figure 10:
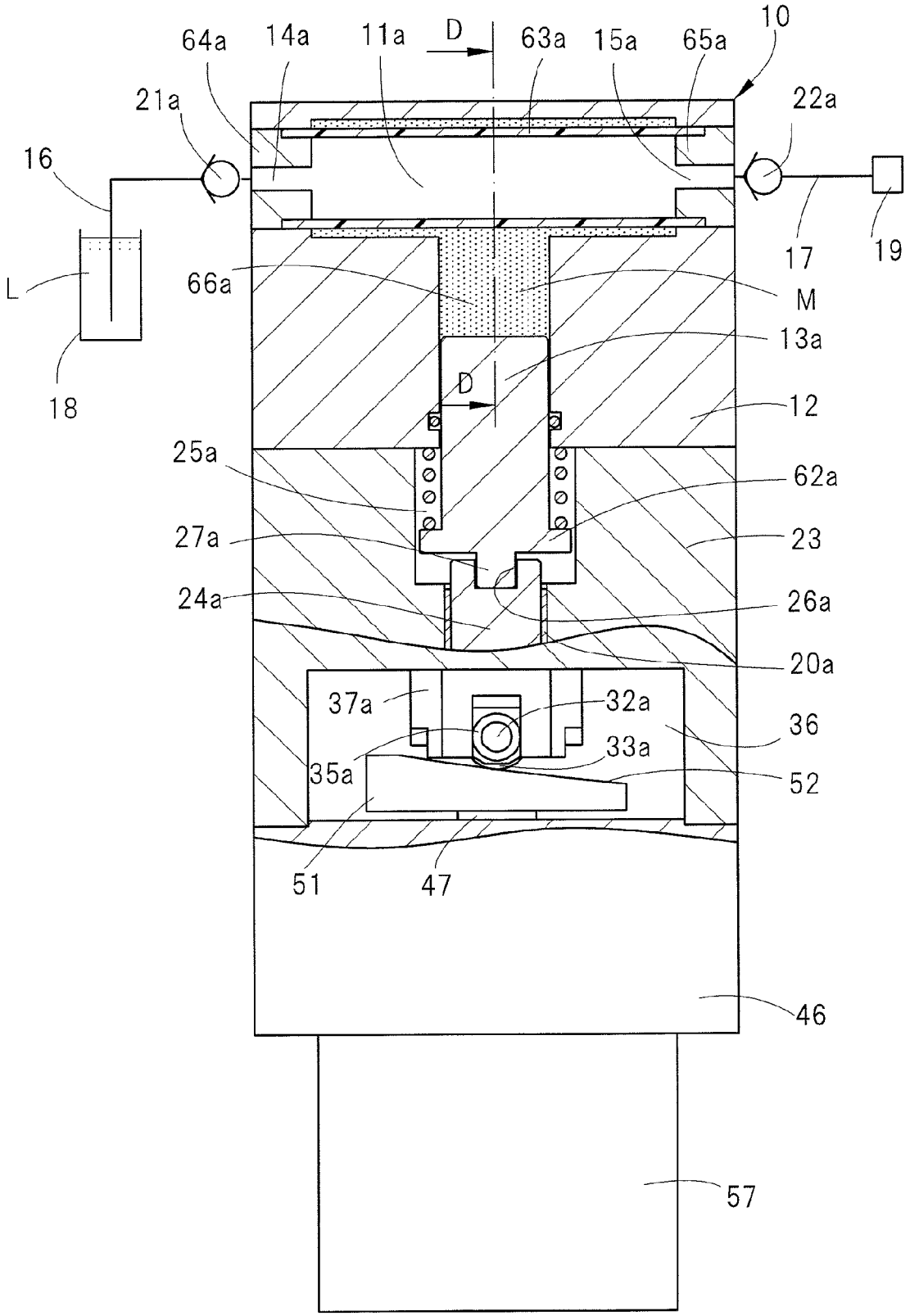
FIG. 10 is a longitudinal cross-sectional view showing a modification example of the liquid supply apparatus.
Figure 11:
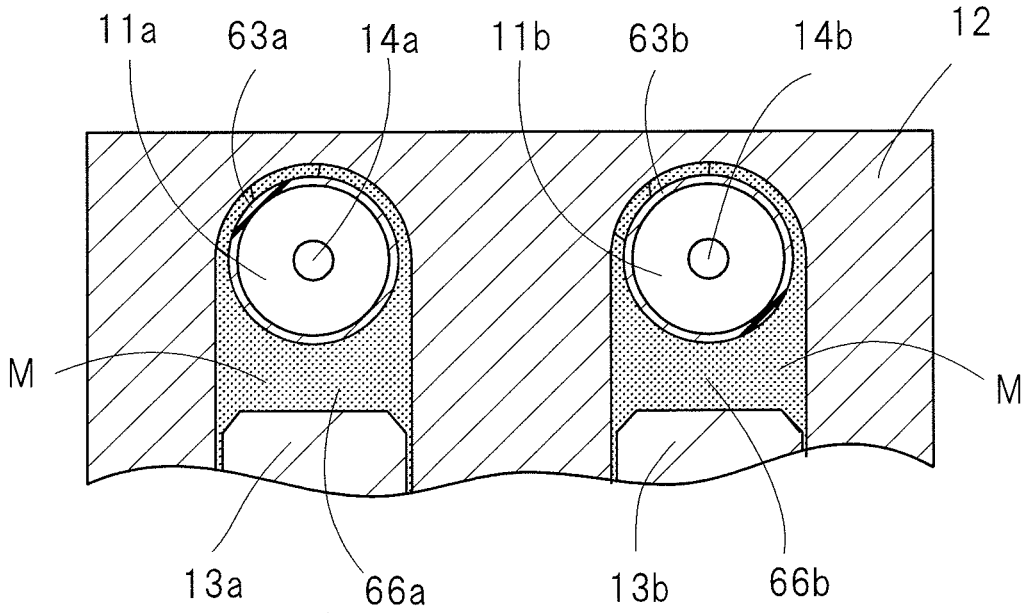
FIG. 11 is a cross-sectional view taken along the line D-D in FIG. 10.

FIG. 10 is a longitudinal cross-sectional view showing a modification example of the liquid supply apparatus, and FIG. 11 is a cross-sectional view taken along the D-D line in FIG. 10. In FIG. 10 and FIG. 11, members having a common function to the members described above are denoted by the same reference characters.

Resin-made tubes 63*a* and 63*b* are mounted as elastically deformable partition members in the cylinder block 12. One end of the tube 63*a* is attached to a joint member 64*a* provided with the suction port 14*a*, and the other end of the tube 63*a* is attached to a joint member 65*a* provided with the discharge port 15*a*. The tube 63*a* separates the chamber, in which the tube 63*a* is housed, into the pump chamber 11*a* on its inside and a drive chamber 66*a* on its outside. The drive chamber 66*a* is partitioned by the plunger 13*a*, which is mounted in the cylinder block 12 so as to be reciprocatable in the axial direction, and the drive chamber 66*a* is filled with a non-compressive indirect working medium M such as liquid.

Like the tube 63*a*, joint members are attached to both ends of the other tube 63*b*, and the tube 63*b* separates the chamber, in which the tube 63*b* is housed, into the pump chamber 11*b* on its inside and a drive chamber 66*b* on its outside. The drive chamber 66*b* is filled with the indirect working medium M. 032 Therefore, in the liquid supply apparatus 10 shown in FIG. 10 and FIG. 11, the pump chambers 11*a* and 11*b* are expanded and contracted via the indirect working medium M by the reciprocating movements of the plungers 13*a* and 13*b* by the drive rods 24*a* and 24*b*. Also in this liquid supply apparatus 10, at least either of the plungers 13*a* and 13*b* or the cylinder block 12 can be replaced.

In each liquid supply apparatus 10, the drive rods 24*a* and 24*b* are coupled to the plungers 13*a* and 13*b* provided in the cylinder block 12. Alternatively, the drive rods 24*a* and 24*b* integrated with portions of the plungers 13*a* and 13*b* may be used.

The present invention is not limited to the embodiments described above, and various modifications can be made within a range of the gist of the present invention. For example, the number of plungers is not limited to two and may be three or more.

What is claimed is:

1. A liquid supply apparatus having a plurality of pump chambers and continuously discharging liquid by expanding and contracting the pump chambers at different timings, the apparatus comprising: a pump block in which a plurality of drive rods which expand and contract the respective pump chambers are mounted so as to be reciprocatable in an axial direction; a plurality of shafts corresponding to the respective driving rods, each of the shafts having a center part attached to a drive roller and having ends respectively attached to guide rollers, each of the shafts being mounted at a base end of a corresponding drive rod so as to be orthogonal to the longitudinal axis of the corresponding drive rod; a plurality of guide blocks mounted in the pump block and each provided with a guide groove for guiding a reciprocating movement of one of the guide rollers in the axial direction of the corresponding drive rod; and an interlocking member provided on a rotation shaft rotatably mounted in the pump block, the interlocking member driving each of the drive rollers to reciprocate in the axial direction in a phase-shifted manner, wherein each of the guide blocks has: a base to be fastened to the pump block; two pair of guide projections provided on the base, one pair forming a guide groove for one of the guide rollers, and the other pair forming a guide groove for the other of the guide rollers; a notch formed so as to be shifted in a circumferential direction with respect to the guide grooves, a screw member for fastening the guide block to the pump block and extending from the notch to the pump block, the base having an outer periphery and an inner periphery forming a through hole, the drive rod penetrating through the through hole and extending toward the corresponding pump chamber, and the notch extending from the inner periphery to the outer periphery.

2. The liquid supply apparatus according to claim 1, wherein two drive rods are provided in the pump block, and when one of the pump chambers is contracted by the interlocking member to discharge the liquid from the pump chamber, another one of the pump chambers is expanded to suction the liquid into the pump chamber.

3. The liquid supply apparatus according to claim 1, wherein a first projection and a second projection which form an accommodation groove for accommodating the drive roller are provided at the base end of each of the drive rods, and a through hole through which the shaft penetrates is provided in the first projection and the second projection.

4. The liquid supply apparatus according to claim 1, further comprising: a cylinder block in which the plurality of pump chambers are formed, wherein plungers which are coupled to the drive rods are mounted in the cylinder block so as to be reciprocatable in the axial direction, and wherein the plungers partition the pump chambers.

5. The liquid supply apparatus according to claim 4, wherein the cylinder block is mounted on the pump block so as to be attachable to and detachable from the pump block, and the plungers are coupled so as to be attachable to and detachable from the drive rods, so that at least either of the plungers or the cylinder block can be replaced.

6. The liquid supply apparatus according to claim 1, further comprising: a cylinder block provided with a plurality of elastically deformable partition members, each of which separates a chamber, in which the partition member is housed, into a drive chamber filled with an indirect working medium and the pump chamber, wherein plungers which are coupled to the drive rods, mounted in the cylinder block so as to be reciprocatable in the axial direction, and partition the drive chambers are provided.

7. The liquid supply apparatus according to claim 6, wherein the cylinder block is mounted on the pump block so as to be attachable to and detachable from the pump block, and the plungers are coupled so as to be attachable to and detachable from the drive rods, so that at least either of the plungers or the cylinder block can be replaced.

8. The liquid supply apparatus according to claim 1, wherein the interlocking member is an end cam in which a cam face with which the drive roller is in contact is formed on an end face of a disk-like cam member.

9. The liquid supply apparatus according to claim 1, wherein the interlocking member is a disk cam in which a cam face with which the drive roller is in contact is formed on an outer circumferential surface of a disk-like cam member.

* * * * *